US009478184B2

(12) United States Patent
Choi et al.

(10) Patent No.: US 9,478,184 B2
(45) Date of Patent: Oct. 25, 2016

(54) METHOD OF DRIVING DISPLAY PANEL AND DISPLAY APPARATUS FOR PERFORMING THE SAME

(75) Inventors: Yong-Jun Choi, Asan-si (KR); Jae-Suk Choi, Uijeongbu-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 996 days.

(21) Appl. No.: 13/241,373

(22) Filed: Sep. 23, 2011

(65) Prior Publication Data

US 2012/0218317 A1 Aug. 30, 2012

(30) Foreign Application Priority Data

Feb. 28, 2011 (KR) ..... 10-2011-0017890

(51) Int. Cl.
*G09G 5/10* (2006.01)
*G09G 3/36* (2006.01)

(52) U.S. Cl.
CPC .... *G09G 3/3655* (2013.01); *G09G 2310/0205* (2013.01); *G09G 2310/0251* (2013.01); *G09G 2320/0257* (2013.01); *G09G 2320/0271* (2013.01); *G09G 2340/16* (2013.01)

(58) Field of Classification Search
CPC ... G09G 3/36; G09G 5/10; G09G 2320/0271
USPC ..... 345/690, 89, 55
See application file for complete search history.

(56) References Cited

U.S. PATENT DOCUMENTS

| | | | | |
|---|---|---|---|---|
| 2005/0195350 | A1* | 9/2005 | Lai | 349/137 |
| 2007/0080915 | A1* | 4/2007 | Nomizo | 345/89 |
| 2008/0062108 | A1* | 3/2008 | Kim | 345/92 |
| 2010/0090995 | A1* | 4/2010 | Chung et al. | 345/205 |
| 2010/0225511 | A1* | 9/2010 | Nishimura | 341/118 |
| 2010/0295843 | A1* | 11/2010 | Liu et al. | 345/214 |

FOREIGN PATENT DOCUMENTS

| | | | |
|---|---|---|---|
| JP | 2010-164844 | A | 7/2010 |
| JP | 2010-237687 | A | 10/2010 |
| KR | 0806906 | B1 | 2/2008 |
| KR | 1020090012650 | A | 2/2009 |

* cited by examiner

*Primary Examiner* — William Boddie
*Assistant Examiner* — Leonid Shapiro
(74) *Attorney, Agent, or Firm* — Cantor Colburn LLP

(57) ABSTRACT

A method of driving a display panel includes generating compensated grayscale data by increasing grayscale data corresponding to an N-th gate line of a plurality of gate lines of the display panel, where N is a natural number, generating a data voltage based on the compensated grayscale data, outputting the data voltage to the display panel including a plurality of pixel electrodes and a plurality of data lines, where each of the plurality of data lines is alternately connected to the plurality of pixel electrodes in a first pixel column and the plurality of pixel electrodes in a second pixel column, generating a storage voltage having a first level and a second level, where the second level is lower than the first level, and applying the storage voltage to the display panel.

18 Claims, 6 Drawing Sheets

METHOD OF DRIVING DISPLAY PANEL AND DISPLAY APPARATUS FOR PERFORMING THE SAME

This application claims priority to Korean Patent Application No. 2011-0017890, filed on Feb. 28, 2011, and all the benefits accruing therefrom under 35 U.S.C. §119, the content of which in its entirety is herein incorporated by reference.

BACKGROUND OF THE INVENTION

1. Field of the Invention

Exemplary embodiments of the invention relate to a method of driving a display panel and a display apparatus for performing the method. More particularly, exemplary embodiments of the invention relate to a method of driving a display panel with improved display quality and a display apparatus for performing the method.

2. Description of the Related Art

Generally, a liquid crystal display ("LCD") apparatus includes a first substrate including a pixel electrode, a second substrate including a common electrode and a liquid crystal layer disposed between the first and second substrates. An electric field is generated by voltages applied to the pixel electrode and the common electrode. By adjusting the intensity of the electric field, the transmittance of light passing through the liquid crystal layer is adjusted so that a desired image may be displayed.

Due to a delay of a circuit, a desired data voltage may not be charged to the pixel electrode. To compensate an amount of the charged data voltage, a precharge driving method, in which an applying duration of a gate signal is longer than one horizontal cycle, has been employed.

Pixels connected to the data line may display a relatively high grayscale and a relatively low grayscale. When the pixels connected to the single data line displays the relatively high grayscale right after the relatively low grayscale in the precharge driving method, a data voltage corresponding to the relatively low grayscale is precharged to the pixel electrode, such that the amount of the charged data voltage may be compensated when the pixel displays the relatively high grayscale.

However, when the pixels connected to the single data line displays the relatively low grayscale right after the relatively high grayscale in the precharge driving method, a data voltage corresponding to the relatively high grayscale precharged to the pixel electrode is not discharged enough, such that a data voltage higher than a desired data voltage corresponding to the relatively low grayscale may be charged to the pixel electrode. Thus, the pixel displaying the relatively low grayscale right after the relatively high grayscale may display a grayscale higher than a desired grayscale, which is called a ghost.

In general, the ghost is more visible to a user when a red pixel and a green pixel are connected to a same adjacent data line, and the red pixel displays a relatively high grayscale and the green pixel displays a relatively low grayscale.

Due to the ghost, display quality of the display panel may be substantially deteriorated.

BRIEF SUMMARY OF THE INVENTION

Exemplary embodiments of the present invention provide a method of driving a display panel with improved display quality.

Exemplary embodiments of the present invention also provide a display apparatus for performing the method of driving the display panel.

In an exemplary embodiment of a method of driving a display panel according to the invention, the method includes generating compensated grayscale data by increasing grayscale data corresponding to an N-th gate line of a plurality of gate lines of the display panel, where N is a natural number, generating a data voltage based on the compensated grayscale data, outputting the data voltage to the display panel including a plurality of pixel electrodes and a plurality of data lines, where each of the plurality of data lines is alternately connected to the plurality of pixel electrodes in a first pixel column and the plurality of pixel electrodes in a second pixel column, generating a storage voltage having a first level and a second level, where the second level is lower than the first level, and applying the storage voltage to the display panel.

In an exemplary embodiment, the method may further include detecting a display error based on the grayscale data, where the grayscale data is increased when the display error is detected.

In an exemplary embodiment, the grayscale data corresponding to the plurality of data lines except for the grayscale data corresponding to an M-th data line of the plurality of data lines may be increased when the display error is detected at the grayscale data corresponding to the M-th data line, where M is a natural number.

In an exemplary embodiment, the detecting the display error may include comparing previous grayscale data corresponding to an (N−1)-th gate line with present grayscale data corresponding to the N-th gate line.

In an exemplary embodiment, the display error may be detected when the previous grayscale data is greater than the present grayscale data.

In an exemplary embodiment, the storage voltage may be applied to the display panel based on an (N+K)-th gate signal, where K is a natural number.

In an exemplary embodiment, the storage voltage may have the second level during an (N+K)-th horizontal cycle.

In an exemplary embodiment, a gate signal applied to the N-th gate line may maintain a turned-on state an (N−2)-th horizontal cycle, an (N−1)-th horizontal cycle and an N-th horizontal cycle, the pixel electrode connected to the N-th gate line may be precharged during the (N−2)-th horizontal cycle and the (N−1)-th horizontal cycle, and K may be greater than or equal to 3.

In an exemplary embodiment, a gate signal applied to the N-th gate line may maintain a turned-on state during an (N−1)-th horizontal cycle and an N-th horizontal cycle, the pixel electrode connected to the N-th gate line may be precharged during the (N−1)-th horizontal cycle, and K may be greater than or equal to 2.

In an exemplary embodiment, a pixel may have a rectangular shape, and a longitudinal side of the pixel may be substantially parallel to the plurality of gate lines.

In an exemplary embodiment of a display apparatus according to the invention, the display apparatus includes a display panel including a plurality of pixel electrodes, a plurality of gate lines and a plurality of data lines, where each of the plurality of data lines is alternately connected to the plurality of pixel electrodes in a first pixel column and the plurality of pixel electrodes in a second pixel column, a grayscale data compensating part which generates compensated grayscale data by increasing grayscale data corresponding to an N-th gate line, where N is a natural number, a data driver which generates a data voltage based on the compensated grayscale data and outputs the data voltage to the display panel and a storage voltage generator which generates a storage voltage having a first level and a second level and applies the storage voltage to the display panel, wherein the second level is lower than the first level.

In an exemplary embodiment, the display apparatus may further include an error detecting part which detects a display error based on the grayscale data, where the grayscale data compensating part may increase the grayscale data when the display error is detected.

In an exemplary embodiment, the grayscale compensating part may increase the grayscale data corresponding to the plurality of data lines except for the grayscale data corresponding to an M-th data line of the plurality of data lines when the display error is detected at the grayscale data corresponding to the M-th data line, where M is a natural number.

In an exemplary embodiment, the error detecting part may compare previous grayscale data corresponding to an (N−1)-th gate line to present grayscale data corresponding to the N-th gate line to detect the display error.

In an exemplary embodiment, the error detecting part may detect the display error when the previous grayscale data is greater than the present grayscale data.

In an exemplary embodiment, the display apparatus may further include a storage switch which applies the storage voltage to a storage electrode of the display panel, where the storage voltage may be applied to the display panel based on an (N+K)-th gate signal, and K is a natural number.

In an exemplary embodiment, the storage voltage may have the second level during an (N+K)-th horizontal cycle.

In an exemplary embodiment, a gate signal applied to the N-th gate line may maintain a turned-on state during an (N−2)-th horizontal cycle, an (N−1)-th horizontal cycle and an N-th horizontal cycle, the pixel electrode connected to the N-th gate line may be precharged during the (N−2)-th horizontal cycle and the (N−1)-th horizontal cycle, and K may be greater than or equal to 3.

In an exemplary embodiment, a gate signal applied to the N-th gate line may maintain a turned-on state during an (N−1)-th horizontal cycle and an N-th horizontal cycle, the pixel electrode connected to the N-th gate line may be precharged during the (N−1)-th horizontal cycle, and K may be greater than or equal to 2.

In an exemplary embodiment, a pixel may have a rectangular shape, and a longitudinal side of the pixel area may be substantially parallel to the plurality of gate lines.

According to exemplary embodiments of the method of driving the display panel and the display apparatus for performing the method, grayscale data are compensated and the storage voltage is adjusted such that a display error is effectively prevented. Thus, display quality of the display panel is substantially improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION OF THE INVENTION

Figure 1:
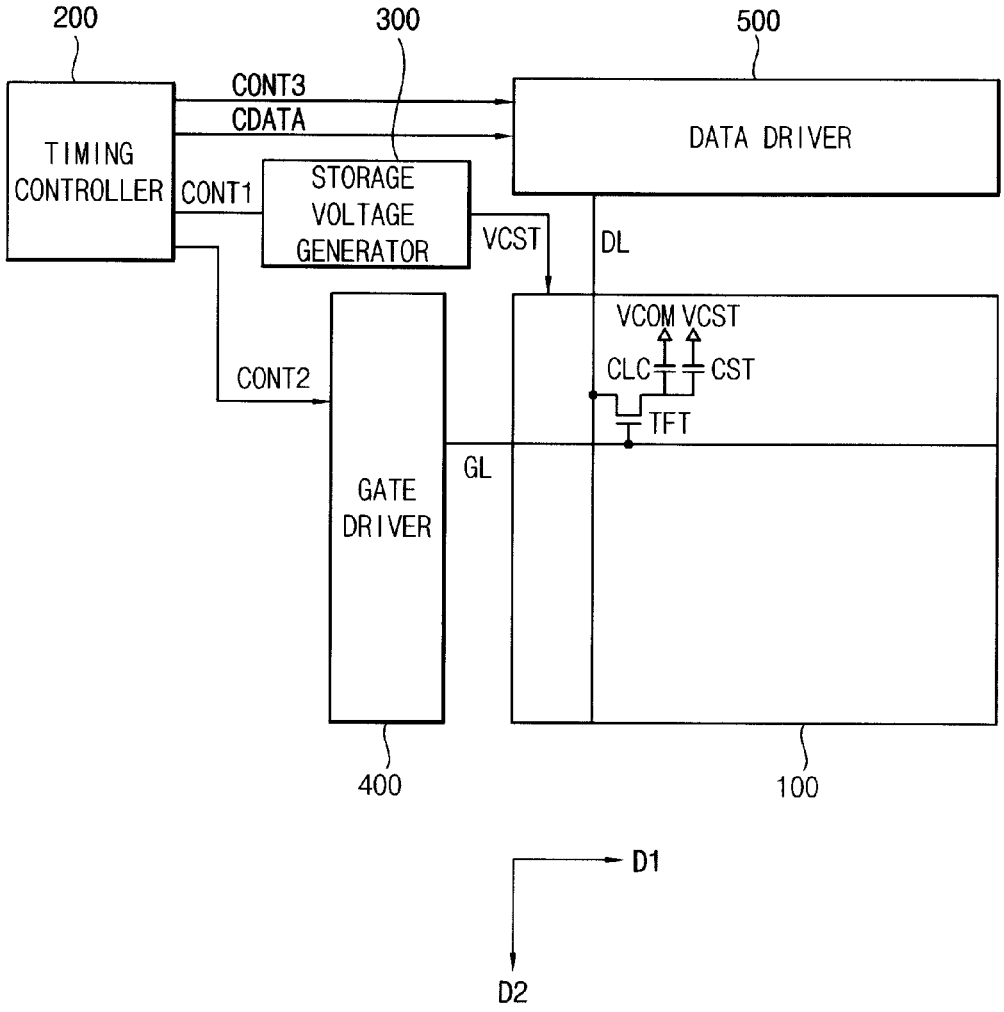
FIG. 1 is a block diagram illustrating an exemplary embodiment of a display apparatus according to the invention.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, "connected" includes physically and/or electrically connected. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings.

FIG. 1 is a block diagram illustrating an exemplary embodiment of a display apparatus according to the invention.

Referring to FIG. 1, the display apparatus includes a display panel 100, a timing controller 200, a storage voltage generator 300, a gate driver 400 and a data driver 500.

The display panel 100 includes a plurality of gate lines GL, a plurality of data lines DL and a plurality of pixels connected to the gate lines GL and the data lines DL.

The gate lines GL extend in a first direction D1, and the data lines DL extend in a second direction D2 crossing the first direction D1. In an exemplary embodiment, the first direction D1 and the second direction D2 may be substantially perpendicular to each other. The pixel includes a switching element TFT, a liquid crystal capacitor CLC and a storage capacitor CST. The liquid crystal capacitor CLC and the storage capacitor CST are electrically connected to the switching element TFT. The pixels are arranged in a matrix form. The switching element TFT may be a thin film transistor.

The liquid crystal capacitor CLC includes a first electrode connected to a pixel electrode and a second electrode connected to a common electrode. A data voltage is applied to the first electrode of the liquid crystal capacitor CLC. A common voltage VCOM is applied to the second electrode of the liquid crystal capacitor CLC. The storage capacitor CST includes a first electrode connected to the pixel electrode and a second electrode connected to a storage electrode. The data voltage is applied to the first electrode of the storage capacitor CST. A storage voltage VCST is applied to the second electrode of the storage capacitor CST. The storage voltage VCST may be substantially equal to the common voltage VCOM.

In one exemplary embodiment, the pixel may have a rectangular shape for example. The rectangular shape of the pixel may have a longitudinal side, e.g., a relatively long side, in the first direction D1 and a latitudinal side, e.g., a relatively short side, in the second direction D2. The longitudinal side of the pixel may be substantially parallel to the gate line GL.

A pixel structure of the display panel 100 will be described later in greater detail referring to FIG. 2.

The timing controller 200 receives input grayscale data and an input control signal from an external apparatus (not shown). The input grayscale data may include red grayscale data, green grayscale data and blue grayscale data. The input control signal may include a master clock signal, a data enable signal, a vertical synchronizing signal and a horizontal synchronizing signal.

The timing controller 200 generates a first control signal CONT1, a second control signal CONT2, a third control signal CONT3 and compensated grayscale data CDATA based on the input grayscale data and the input control signal.

The timing controller 200 generates the first control signal CONT1 based on the input grayscale data, and outputs the first control signal CONT1 to the storage voltage generator 300.

The timing controller 200 generates the second control signal CONT2 based on the input control signal to control a driving timing of the gate driver 400, and outputs the second control signal CONT2 to the gate driver 400. The second control signal CONT2 may include a vertical start signal and a gate clock signal.

The timing controller 200 generates the third control signal CONT3 based on the input control signal to control a driving timing of the data driver 500, and outputs the third control signal CONT3 to the data driver 500. The third control signal CONT3 may include a horizontal start signal and a load signal.

The timing controller 200 generates the compensated grayscale data CDATA based on the input grayscale data, and outputs the compensated grayscale data CDATA to the data driver 500.

An operation of the timing controller will be described later in greater detail referring to FIG. 3.

The storage voltage generator 300 generates the storage voltage VCST. The storage voltage generator 300 applies the storage voltage VCST to the storage electrode of the display panel 100.

The storage voltage VCST may have a first level and a second level. The second level may be lower than the first level. The first level of the storage voltage VCST may be substantially equal to the common voltage VCOM.

However, when the data voltage is lower than the common voltage VCOM in an inverting driving method of the display panel 100, the second level may be higher than the first level. Hereinafter, an exemplary embodiment, in which the display panel 100 is driven in a positive polarity, e.g., the data voltage is higher than the common voltage VCOM, is will be described for convenience of description, but the invention is not limited thereto.

The storage voltage generator 300 receives the first control signal CONT1 from the timing controller 200. The storage voltage generator 300 may adjust the storage voltage VCST to have the second level in response to the first control signal CONT1.

The first control signal CONT1 may include a display error signal indicating an occurrence of a display error when the input grayscale data is displayed on the display panel 100. In one exemplary embodiment, for example, the display error may occur in the pixel connected to a single data line and displaying a relatively low grayscale by displaying a grayscale higher than a desired low grayscale when the input grayscale data applied to the single data line is changed from a relatively high grayscale to the relatively low grayscale.

In an exemplary embodiment, the storage voltage generator 300 is disposed outside the timing controller 200, as shown in FIG. 1. In an alternative exemplary embodiment, the storage voltage generator 300 may be disposed in the timing controller 200. In another alternative exemplary embodiment, the storage voltage generator 300 may be disposed in the data driver 500.

In an exemplary embodiment, the storage voltage generator 300 directly applies the storage voltage VCST to the display panel 100, as shown in FIG. 1. In an alternative exemplary embodiment, the storage voltage generator 300 may apply storage voltage VCST to the display panel 100 via the data driver 500.

The gate driver 400 receives the second control signal CONT2 from the timing controller 200. The gate driver 400 generates gate signals for driving the gate lines GL in response to the second control signal CONT2. The gate driver 400 sequentially outputs the gate signals to the gate lines GL.

In an exemplary embodiment, the gate driver 400 may be disposed, e.g., directly mounted, on the display panel 100, or be connected to the display panel 100 in a tape carrier package ("TCP") type. In an alternative exemplary embodiment, the gate driver 500 may be integrated on the display panel 100.

The data driver 500 receives the third control signal CONT3 and the compensated grayscale data CDATA from the timing controller 200. The data driver 500 receives a gamma reference voltage from a gamma voltage generator (not shown). The gamma voltage generator may be disposed in the data driver 500.

The data driver 500 converts the compensated grayscale data CDATA into data voltages having analogue types using the gamma reference voltage in response to the third control signal CONT3. The data driver 500 sequentially outputs the data voltages to the data lines DL.

The data driver 500 may include a shift register (not shown), a latch (not shown), a signal processor (not shown) and a buffer (not shown). The shift register outputs a latch pulse to the latch. The latch temporarily stores the compensated grayscale data CDATA, and outputs the compensated grayscale data CDATA to the signal processor. The signal processor generates the data voltages having analogue types based on the compensated grayscale data CDATA having digital types and the gamma reference voltages, and outputs the data voltages to the buffer. The buffer compensates the data voltages to have a uniform level, and outputs the data voltages to the data lines DL.

The data driver 500 may be disposed, e.g., directly mounted, on the display panel 100, or be connected to the display panel 100 in a TCP type. Alternatively, the data driver 500 may be integrated on the display panel 100.

Figure 2:
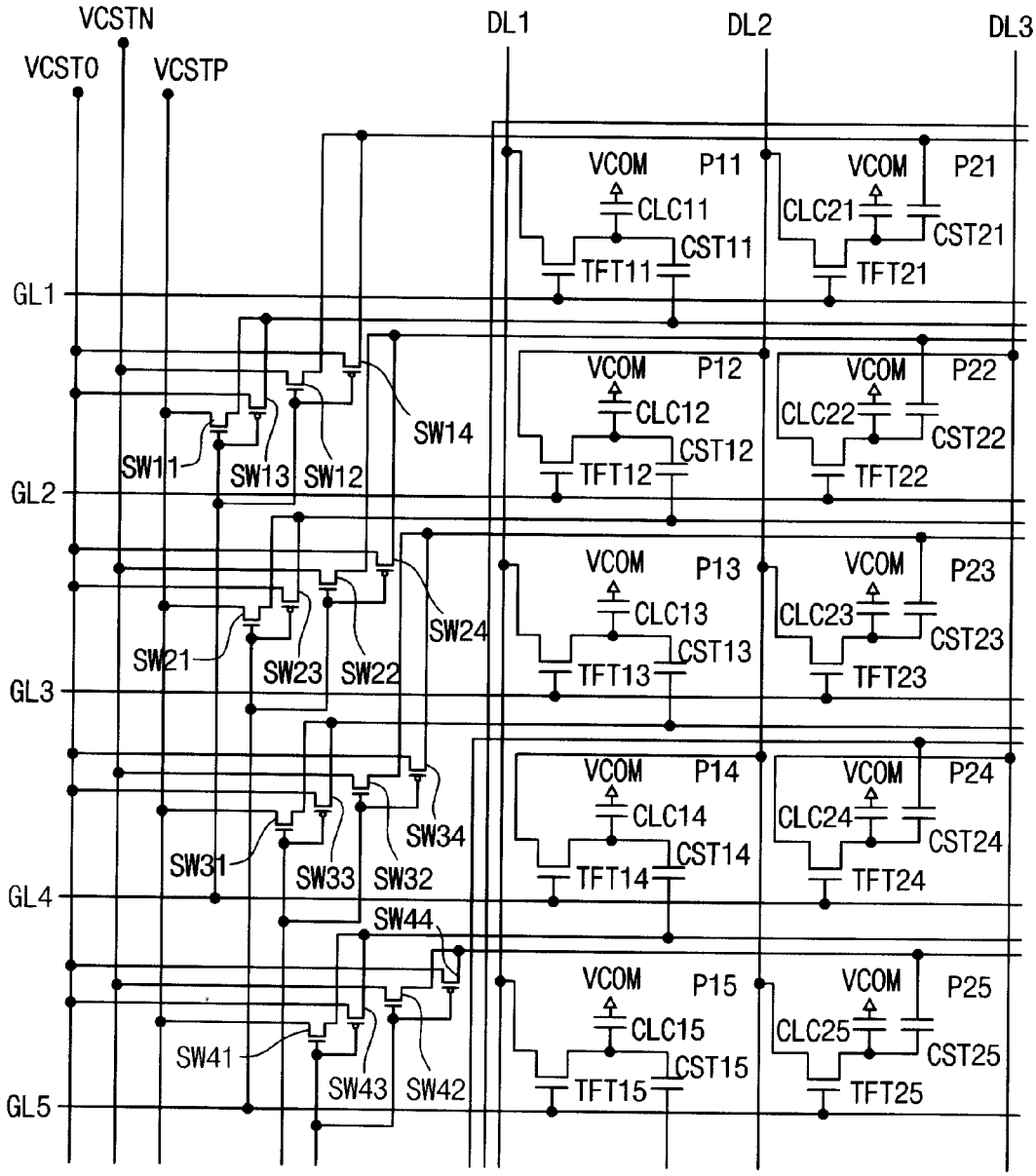
FIG. 2 is a schematic circuit diagram illustrating an exemplary embodiment of a pixel structure of a display panel of FIG. 1.

FIG. 2 is a schematic circuit diagram illustrating an exemplary embodiment of a pixel structure of the display panel 100 of FIG. 1.

Referring to the FIGS. 1 and 2, the display panel 100 includes a plurality of pixels, e.g., first to tenth pixels P11, P12, P13, P14, P15, P21, P22, P23, P24 and P25. In FIG. 2, a part of the entire pixels of the display panel 100 disposed in a matrix form are shown for convenience of description.

In one exemplary embodiment, as shown in FIG. 2, the pixels P11 to P25 are disposed in a first pixel column and a second pixel column. The first pixel column includes the first to fifth pixels P11, P12, P13, P14 and P15. The second pixel column includes the sixth to tenth pixels P21, P22, P23, P24 and P25.

Each of the pixels is electrically connected to a corresponding gate line of the gate lines GL and a corresponding data line of the data lines DL. Each data line DL is alternately connected to the pixels in adjacent pixel columns. In one exemplary embodiment, for example, a second data line DL2 is sequentially connected to the first pixel P11 in the first pixel column, the seventh pixel P22 in the second pixel column, the third pixel P13 in the first pixel column, the ninth pixel P24 in the second pixel column and the fifth pixel P15 in the first pixel column. Each of the pixels includes the switching element TFT, the liquid crystal capacitor CLC and the storage capacitor CST.

In one exemplary embodiment, for example, the first pixel P11 is electrically connected to a first gate line GL1 and a first data line DL1. The first pixel P11 includes a first switching element TFT11, a first liquid crystal capacitor CLC11 and a first storage capacitor CST11.

In one exemplary embodiment, for example, the second pixel P12 is electrically connected to a second gate line GL2 and a second data line DL2. The second pixel P12 includes a second switching element TFT12, a second liquid crystal capacitor CLC12 and a second storage capacitor CST12.

In one exemplary embodiment, for example, the third pixel P13 is electrically connected to a third gate line GL3 and the first data line DL1. The third pixel P13 includes a third switching element TFT13, a third liquid crystal capacitor CLC13 and a third storage capacitor CST13.

In one exemplary embodiment, for example, the fourth pixel P14 is electrically connected to a fourth gate line GL4 and the second data line DL2. The fourth pixel P14 includes a fourth switching element TFT14, a fourth liquid crystal capacitor CLC14 and a fourth storage capacitor CST14.

In one exemplary embodiment, for example, the fifth pixel P15 is electrically connected to a fifth gate line GL5 and the first data line DL1. The fifth pixel P15 includes a fifth switching element TFT15, a fifth liquid crystal capacitor CLC15 and a fifth storage capacitor CST15.

In one exemplary embodiment, for example, the sixth pixel P21 is electrically connected to the first gate line GL1 and the second data line DL2. The sixth pixel P21 includes a sixth switching element TFT21, a sixth liquid crystal capacitor CLC21 and a sixth storage capacitor CST21.

In one exemplary embodiment, for example, the seventh pixel P22 is electrically connected to the second gate line GL2 and a third data line DL3. The seventh pixel P22 includes a seventh switching element TFT22, a seventh liquid crystal capacitor CLC22 and a seventh storage capacitor CST22.

In one exemplary embodiment, for example, the eighth pixel P23 is electrically connected to the third gate line GL3 and the second data line DL2. The eighth pixel P23 includes an eighth switching element TFT23, an eighth liquid crystal capacitor CLC23 and an eighth storage capacitor CST23.

In one exemplary embodiment, for example, the ninth pixel P24 is electrically connected to the fourth gate line GL4 and the third data line DL3. The ninth pixel P24 includes a ninth switching element TFT24, a ninth liquid crystal capacitor CLC24 and a ninth storage capacitor CST24.

In one exemplary embodiment, for example, the tenth pixel P25 is electrically connected to the fifth gate line GL5 and the second data line DL2. The tenth pixel P25 includes a tenth switching element TFT25, a tenth liquid crystal capacitor CLC25 and a tenth storage capacitor CST25.

A plurality of storage switches, e.g., first to sixteenth switches SW11, SW12, SW13, SW14, SW21, SW22, SW23, SW24, SW31, SW32, SW33, SW34, SW41, SW42, SW43 and SW44, applies the storage voltage VCST to the display panel 100. The storage switch may be a transistor.

In an exemplary embodiment, in which the display panel 100 is driven in the inverting driving method, the storage voltage VCST may include a normal storage voltage VCST0, a first storage voltage VCSTP and a second storage voltage VCSTN.

In one exemplary embodiment, for example, the first storage voltage VCSTP may have a positive polarity with respect to the normal storage voltage VCST0. The second storage voltage VCSTN may have a negative polarity with respect to the normal storage voltage VCST0. In an alternative exemplary embodiment, the first storage voltage VCSTP may have a negative polarity with respect to the normal storage voltage VCST0. The second storage voltage VCSTN may have a positive polarity with respect to the normal storage voltage VCST0.

Control electrodes of the first, second, third and fourth storage switches SW11, SW12, SW13 and SW14 are connected to the fourth gate lines GL4. In an exemplary embodiment, each of the storage switches may be a transistor, and the control electrode may be a gate electrode of the transistor.

In an exemplary embodiment, a gate signal of the fourth gate line GL4 is applied to the control electrodes of the first and second storage switches SW11 and SW12 without inversion.

In such an embodiment, when the gate signal of the fourth gate line GL4 is a turn-on signal, the first storage switch SW11 applies the first storage voltage VCSTP to the first storage capacitor CST11 of the first pixel P11. When the gate signal of the fourth gate line GL4 is a turn-on signal, the second storage switch SW12 applies the second storage voltage VCSTN to the sixth storage capacitor CST21 of the sixth pixel P21.

In an exemplary embodiment, a gate signal of the fourth gate line GL4 is applied to the control electrodes of the third and fourth storage switches SW13 and SW14 with inversion.

In such an embodiment, when the gate signal of the fourth gate line GL4 is a turn-off signal, the third storage switch SW13 applies the normal storage voltage VCST0 to the first storage capacitor CST11 of the first pixel P11. When the gate signal of the fourth gate line GL4 is a turn-off signal, the fourth storage switch SW14 applies the normal storage voltage VCST0 to the sixth storage capacitor CST21 of the sixth pixel P21.

Control electrodes of the fifth, sixth, seventh and eighth storage switches SW21, SW22, SW23 and SW24 are connected to the fifth gate lines GL5.

The fifth storage switch SW21 applies the first storage voltage VCSTP to the second switch capacitor CST12 of the second pixel P12. The sixth storage switch SW22 applies to the seventh switch capacitor CST 22 of the seventh pixel P22.

The seventh and eighth storage switches SW23 and SW24 apply the normal storage voltage VCST0 to the second switch capacitor CST12 of the second pixel P12 and the seventh switch capacitor CST 22 of the seventh pixel P22, respectively.

Similarly to the structure described above, the ninth to twelfth storage switches SW31, SW32, SW33 and SW34 are connected to a sixth gate line (not shown), and the thirteenth to sixteenth storage switches SW41, SW42, SW 43 and SW44 are connected to a seventh gate line (not shown).

In such an embodiment, the normal, first and second storage voltages VCST0, VCSTP and VCSTN are applied to the first and sixth pixels P11 and P21, which are connected to the first gate line GL1, through the first to fourth storage switches SW11, SW12, SW13 and SW14, which are connected to the fourth gate line GL4.

The normal, first and second storage voltages VCST0, VCSTP and VCSTN are applied to the second and seventh pixels P12 and P22, which are connected to the second gate line GL2, through the fifth to eighth storage switches SW21, SW22, SW23 and SW24, which are connected to the fifth gate line GL5.

In such an embodiment, the normal, first and second storage voltages VCST0, VCSTP and VCSTN are applied to the pixels, which are connected to N-th gate line, through the storage switches, which are connected to the (N+3)-th gate line. Here, N is a natural number.

Figure 3:
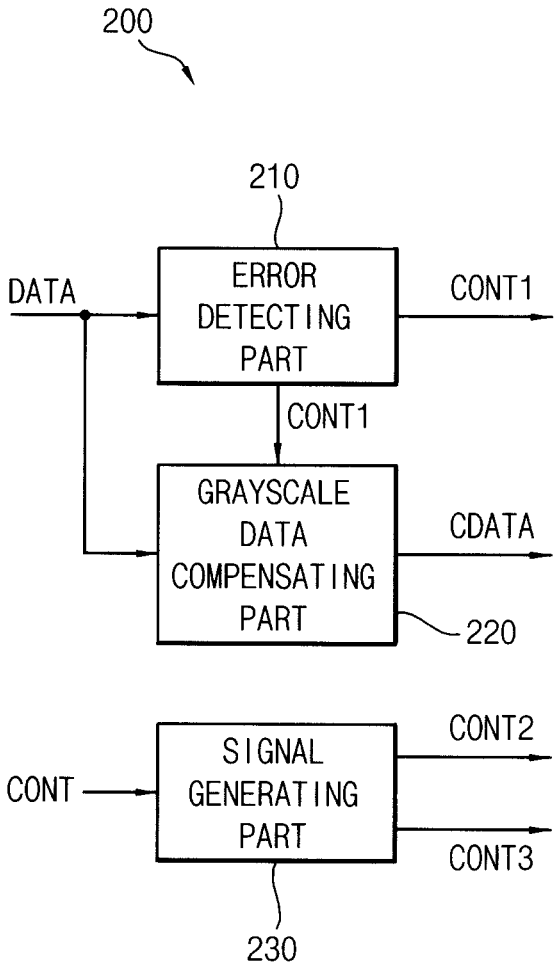
FIG. 3 is a block diagram illustrating an exemplary embodiment of a timing controller of FIG. 1.

FIG. 3 is a block diagram illustrating an exemplary embodiment of the timing controller 200 of FIG. 1.

Referring to FIG. 3, the timing controller 200 includes an error detecting part 210, a grayscale data compensating part 220 and a signal generating part 230. In an exemplary embodiment, the elements of the timing controller 200 may not be physically divided. In FIG. 3, however, the elements of the timing controller 200 are separately shown for convenience of description.

The error detecting part 210 receives the input grayscale data DATA. In one exemplary embodiment, for example, the error detecting part 210 may receive the input grayscale data DATA from an external apparatus. In an alternative exemplary embodiment, the error detecting part 210 may receive the input grayscale data DATA from another element in the timing controller 200. The error detecting part 210 detects the display error based on the input grayscale data DATA.

The error detecting part 210 detects the display error of a pixel connected to an N-th gate line by comparing previous grayscale data corresponding to (N−1)-th gate line with present grayscale data corresponding to the N-th gate line. In such an embodiment, the previous grayscale data and the present grayscale data are grayscale data of pixels connected to a same data line.

In one exemplary embodiment, for example, the error detecting part 210 may detect the display error when the previous grayscale data have a grayscale value greater than a grayscale value of the present grayscale data.

Hereinafter, the display error occurrence will be described in detail referring again to FIG. 2.

In an exemplary embodiment, when a data voltage corresponding to a relatively high grayscale is applied to the sixth pixel P21 connected to the second data line DL2 and a data voltage corresponding to a relatively low grayscale is applied to the second pixel P12 connected to the second data line DL2, the data voltage corresponding to the relatively low grayscale for the second pixel P12 is charged to the second pixel P12 after the data voltage corresponding to the relatively high grayscale for the sixth pixel P21 is precharged to the second pixel P12. In such an embodiment, when the second pixel P12 is not sufficiently discharged, the second pixel P12 may display a grayscale higher than a desired grayscale, and the display error may occur.

The error detecting part 210 detects the display error of the pixel connected to the second gate line GL2 by comparing previous grayscale data (e.g., the grayscale data of sixth pixel P21) corresponding to first gate line GL1 with present grayscale data (e.g., the grayscale data of second pixel P12) corresponding to the second gate line GL2.

In such an embodiment, when a difference between the previous grayscale data and the present grayscale data becomes greater, the degree of the display error may become greater.

Referring to FIGS. 1 and 3, the error detecting part 210 generates the first control signal CONT1, and outputs the first control signal CONT1 to the grayscale data compensating part 220 and the storage voltage generator 300. The first control signal CONT1 may include the display error signal.

The grayscale data compensating part 220 receives the input grayscale data DATA. The grayscale data compensating part 220 receives the first control signal CONT1 from the error detecting part 210.

The grayscale data compensating part 220 increases the input grayscale data DATA to generate the compensated grayscale data CDATA in response to the first control signal CONT1.

When the data voltage is lower than the common voltage VCOM in an inverting driving method of the display panel 100, the grayscale data compensating part 220 may decreases the input grayscale data DATA to generate the compensated grayscale data CDATA.

When the display error occurs in the input grayscale data of an M-th data line, the grayscale data compensating part 220 may increase the input grayscale data of the data lines except for the M-th data line. Here, M is a natural number.

Referring again to FIG. 2, when the sixth pixel P21 connected to the second data line DL2 has the input grayscale data corresponding to a relatively high grayscale and the second pixel P12 connected to the second data line DL2 has the input grayscale data corresponding to a relatively low grayscale, the display error occurs at the second pixel P12.

The grayscale data compensating part 220 may increase the input grayscale data of the data lines except for the second data line DL2.

In one exemplary embodiment, for example, the grayscale data compensating part 220 may increase the input grayscale data of the seventh pixel P22 connected to the second gate line GL2, to which the second pixel P12 is connected, and the third data line DL3. Similarly, the grayscale data compensating part 220 may increase the input grayscale data of a twelfth pixel (not shown) connected to the second gate line GL2 and the fourth data line (not shown), the input grayscale data of a seventeenth pixel (not shown) connected to the second gate line GL2 and the fifth data line (not shown), the input grayscale data of a twenty second pixel (not shown) connected to the second gate line GL2 and the sixth data line (not shown), for example.

In one exemplary embodiment, for example, when a grayscale of each of the second pixel P12, the seventh pixel P22, the twelfth pixel, the seventeenth pixel, the twenty second pixel has a grayscale value of 10, a data voltage corresponding to a grayscale having a value higher than the grayscale value of 10 is charged to the second pixel P12 such that the second pixel P12 may display a luminance brighter than a luminance corresponding to the grayscale value of 10. When the second pixel P12 displays a grayscale corresponding to a grayscale value of 20, which is grater than 10, the grayscale data compensating part 220 compensates the input grayscale data DATA such that each of the seventh pixel P22, the twelfth pixel, the seventeenth pixel and the twenty second pixel displays a grayscale corresponding to the grayscale value of 20.

In such an embodiment, each of the pixels connected to the second gate line GL2 displays a grayscale corresponding to a grayscale value of 20 which is brighter than a grayscale corresponding to a grayscale value of 10. Accordingly, a luminance difference between the second pixel P12, at which the display error occurs, and the seventh, twelfth, seventeenth and twenty second pixels, at which the display error is not occurred, is substantially decreased or effectively prevented.

In such an embodiment, after the grayscale data compensating part 220 compensates the input grayscale data DATA, a level of the storage voltage VCST may be adjusted to decrease data voltages charged to the pixels connected to the second gate line GL2. In one exemplary embodiment, for example, the data voltages charged to the pixels connected to the second gate line GL2 are decreased to correspond to a grayscale having a grayscale value of 10, and the display error is thereby effectively prevented. In one exemplary embodiment, for example, the level of the storage voltage VCST may be adjusted from a first level to a second level lower than the first level.

The grayscale data compensating part 220 may generate the compensated grayscale data CDATA using the difference between the previous grayscale data and the present grayscale data. The grayscale data compensating part 220 may generate the compensated grayscale data CDATA using a lookup table. Table 1 shows an exemplary embodiment of the lookup table.

TABLE 1

| Difference between previous grayscale data and present grayscale data | Increasing grayscale value |
|---|---|
| 1 | 0 |
| 2 | 0 |
| . . . | . . . |
| 88 | 20 |
| 89 | 20 |
| . . . | . . . |
| 102 | 30 |
| 103 | 30 |
| . . . | . . . |
| 121 | 40 |
| 122 | 40 |
| . . . | . . . |
| 145 | 50 |
| 146 | 50 |
| . . . | . . . |
| 185 | 60 |
| 186 | 60 |
| . . . | . . . |
| 256 | 60 |

Referring to Table 1, when the difference between the previous grayscale data and the present grayscale data is a grayscale value of 1, the display error may not occur, and thus the present grayscale data are not increased. When the difference between the previous grayscale data and the present grayscale data is a grayscale value of 88, the display error occurs, and that thus the present grayscale data of the data lines, except for the data line at which the display error occurs, are increased by a grayscale value of 20. When the difference between the previous grayscale data and the present grayscale data is a grayscale value of 102, the display error occurs, and thus that the present grayscale data of the data lines, except for the data line at which the display error occurs, are increased by a grayscale value of 30. When the difference between the previous grayscale data and the present grayscale data is a grayscale value of 121, the display error occurs, and thus the present grayscale data of the data lines, except for the data line at which the display error occurs, are increased by a grayscale value of 40. When the difference between the previous grayscale data and the present grayscale data is a grayscale of 145, the display error occurs, and thus the present grayscale data of the data lines, except for the data line at which the display error occurs, are increased by a grayscale value of 50. When the difference between the previous grayscale data and the present grayscale data is a grayscale value of 185, the display error occurs so that the present grayscale data of the data lines, except for the data line at which the display error occurs, are increased by a grayscale value of 60.

The increasing grayscale value in the lookup table may be adjusted based on optical characteristics of the display panel 100.

The timing controller 200 may further include a memory (not shown). The lookup table may be stored in the memory.

The grayscale data compensating part 220 outputs the compensated grayscale data CDATA to the data driver 500.

The signal generating part 230 receives the input control signal CONT. The signal generating part 230 generates the second control signal CONT2 to control a driving timing of the gate driver 400 based on the input control signal CONT. The signal generating part 230 generates the third control signal CONT3 to control a driving timing of the data driver 500 based on the input control signal CONT.

The signal generating part 230 outputs the second control signal CONT2 to the gate driver 400. The signal generating part 230 outputs the third control signal CONT3 to the data driver 500.

The timing controller 200 may further include an adaptive color correcting part (not shown), and a dynamic capacitance compensating part (not shown).

The adaptive color correcting part receives the grayscale data, and operates an adaptive color correction ("ACC"). The adaptive color correcting part may compensate the grayscale data using a gamma curve.

The dynamic capacitance compensating part operates a dynamic capacitance compensation ("DCC"), which compensates the grayscale data of present frame data using previous frame data and the present frame data.

The adaptive color correcting part and the dynamic capacitance compensating part may be connected to the error detecting part 210 and the grayscale data compensating part 220 such that the input grayscale data DATA are compensated and the compensated input grayscale data are provided to the error detecting part 210 and the grayscale data compensating part 220.

Figure 4:
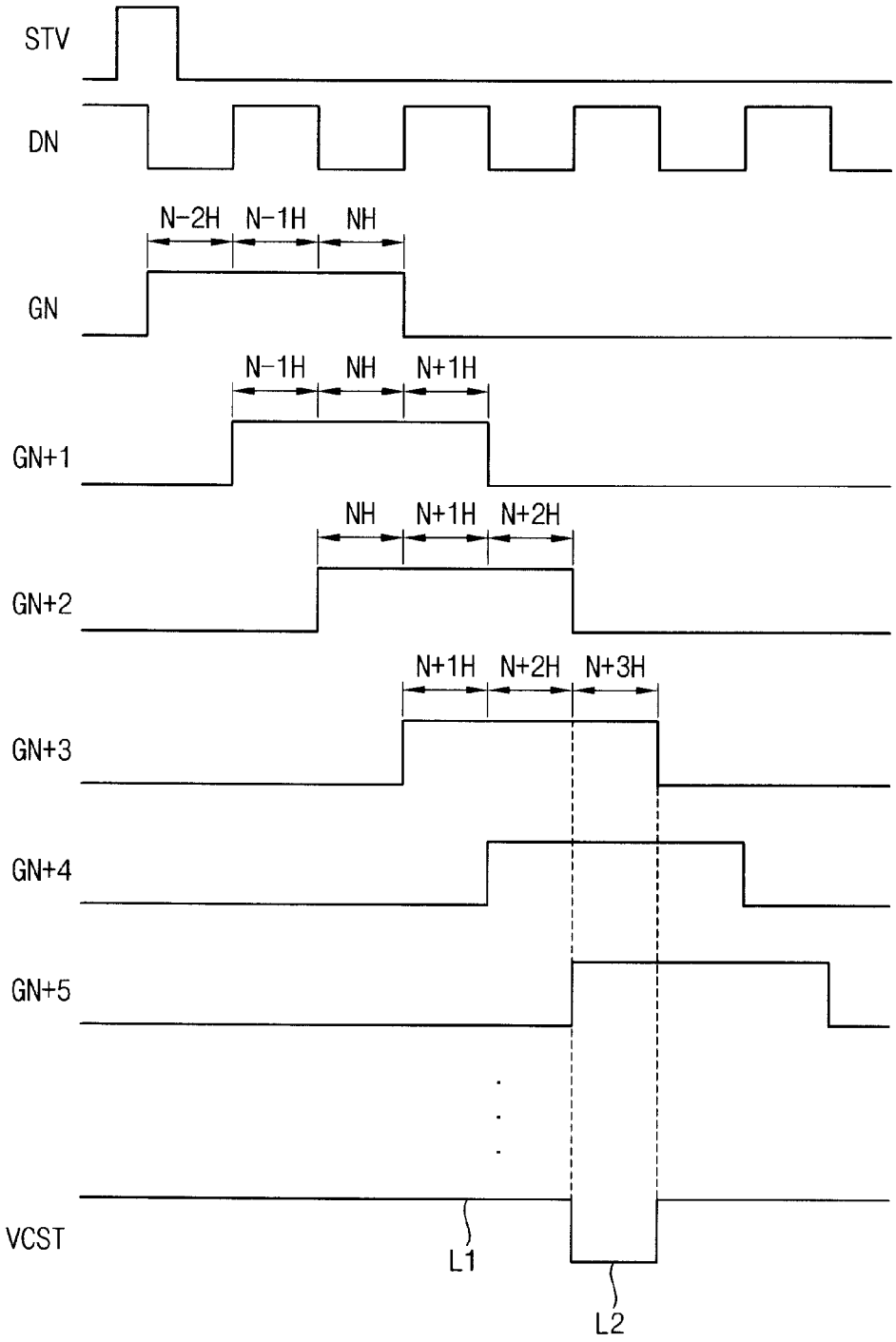
FIG. 4 is a signal timing diagram illustrating driving signals for driving the display panel of FIG. 1.

FIG. 4 is a signal timing diagram illustrating driving signals for driving the display panel 100 of FIG. 1.

Referring to FIGS. 1 to 4, when a vertical start signal STV is turned on e.g., the vertical signal is in a turned-on ("ON") state, gate signals are sequentially applied to the gate lines, e.g., a first gate signal is applied to the first gate line GL1 and an N-th gate signal GN is applied to an N-th gate line GLN.

In such an embodiment, the gate signals maintain ON state for three horizontal cycles, and the grayscale data may be precharged to the pixels during first and second horizontal cycles, and the grayscale data are charged to the pixels during a third horizontal cycle.

In one exemplary embodiment, for example, the N-th gate signal GN maintains ON state during (N−2)-th, (N−1)-th and N-th horizontal cycles N−2H, N−1H and NH. During the (N−2)-th horizontal cycle N−2H, a data voltage DN corresponding to an (N−2)-th gate line is precharged to a pixel connected to the N-th gate line. During the (N−1)-th horizontal cycle N−1H, a data voltage DN corresponding to an (N−1)-th gate line is precharged to the pixel connected to the N-th gate line. During the N-th horizontal cycle NH, a data voltage DN corresponding to N-th gate line is charged to the pixel connected to the N-th gate line.

In one exemplary embodiment, for example, an (N+1)-th gate signal GN+1 maintains the ON state during (N−1)-th, N-th and (N+1)-th horizontal cycles N−1H, NH and N+1H. During the (N−1)-th horizontal cycle N−1H, a data voltage DN corresponding to (N−1)-th gate line is precharged to a pixel connected to the (N+1)-th gate line. During the N-th horizontal cycle NH, a data voltage DN corresponding to N-th gate line is precharged to the pixel connected to the (N+1)-th gate line. During the (N+1)-th horizontal cycle N+1H, a data voltage DN corresponding to (N+1)-th gate line is charged to the pixel connected to the (N+1)-th gate line.

When the data voltage DN applied during the (N−1)-th horizontal cycle N−1H corresponds to a relatively high grayscale, and the data voltage DN applied during the N-th horizontal cycle NH corresponds to a relatively low grayscale, the display error may occur at the pixel connected to the N-th gate line.

When the display error occurs at the pixel connected to the N-th gate line, the grayscale data compensating part 220 increases input grayscale data DATA of the data lines, except for the data line at which the display error occurs, to generate compensated grayscale data CDATA.

Accordingly, the data driver 500 outputs a data voltage corresponding to a grayscale value higher than a grayscale value of the input grayscale data DATA to the pixels connected to the N-th gate line based on the compensated grayscale data CDATA.

The storage voltage VCST has the first level L1 during (N−2)-th to (N+2)-th horizontal cycles N−2H to N+2H. The storage voltage VCST has the second level L2 lower than the first level L1 during (N+3)-th horizontal cycle N+3H.

Referring to FIG. 2, the (N+3)-th gate line is connected to the storage switches that apply the storage voltage VCST to the pixels connected to the N-th gate line.

During the (N+3)-th horizontal cycle N+3H, the storage voltage having the second level L2 lower than the first level L1 decreases the data voltage charged to the pixels connected to the N-th gate line.

Accordingly, the data voltages of the pixels connected to the N-th gate line, which are compensated to display a grayscale higher than a desired grayscale by the grayscale data compensating part 220, may be adjusted such that the pixels display the desired grayscale. Thus, the display error on the display panel 100 is effectively prevented.

A time period during which the storage voltage VCST has the second level L2 is not limited to the (N+3)-th horizontal cycle N+3H. In an exemplary embodiment, the storage voltage VCST may have the second level L2 during an (N+K)-th horizontal cycle. Here, K is a natural number. When the time period during which the storage voltage VCST has the second level L2 is changed, the gate line connected to the control electrodes of the storage switches may be also changed.

In an exemplary embodiment, the storage voltage VCST may have the second level L2 during (N+2)-th horizontal cycle N+2H.

In one exemplary embodiment, for example, when the storage voltage VCST has the second level L2 during (N+2)-th horizontal cycle N+2H, the control electrodes of the storage switches that apply the storage voltage VCST to the pixels connected to the N-th gate line are connected to the (N+2)-th gate line.

In one exemplary embodiment, for example, when the storage voltage VCST has the second level L2 during (N+4)-th horizontal cycle, the control electrodes of the storage switches that apply the storage voltage VCST to the pixels connected to the N-th gate line are connected to the (N+4)-th gate line.

In such an embodiment, K may be equal to or greater than 3. When the storage voltage VCST has the second level L2 after (N+3)-th horizontal cycle, in which the N-th gate signal applied to the N-th gate line maintains a turned-off ("OFF") state, the display panel 100 may be driven more stably.

Equation 1 represents a decrease of the data voltage charged to the pixel according to a decrease of the storage voltage VCST.

$$\Delta VCST = \left(\frac{CLC + CST}{CST}\right) \times \Delta VCLC \quad \text{[Equation 1]}$$

In Equation 1, ΔVCST denotes an amount of the decrease of the storage voltage, CLC denotes a capacitance of the liquid crystal capacitor, CST denotes a capacitance of the storage capacitor, and ΔVCLC denotes an amount of the decrease of the data voltage charged to the pixel.

In one exemplary embodiment, for example, when the data voltage is increased by 2V by the grayscale data compensating part 220, the data voltage may be decreased by 2V by adjusting the storage voltage VCST.

When ΔVCST=2 and CLC:CST=2:1, $$\Delta VCST = \left(\frac{2+1}{1}\right) \times 2 = 6 \text{ (V)}.$$

In one exemplary embodiment, for example, when the storage voltage VCST is decreased by 6 volt (V), the data voltage VCLC charged to the liquid crystal capacitor CLC is recovered to the desired grayscale so that the display error may be prevented. The second level L2 of the storage voltage VCST is lower than the first level L1 by 6 V.

According to the exemplary embodiment shown in FIGS. 1 to 4, the error detecting part 210 detects the display error. The grayscale data compensating part 220 compensates the input grayscale data DATA. The storage voltage generator 300 adjusts a level of the storage voltage VCST. Thus, the display error on the display panel 100 is effectively prevented.

Figure 5:
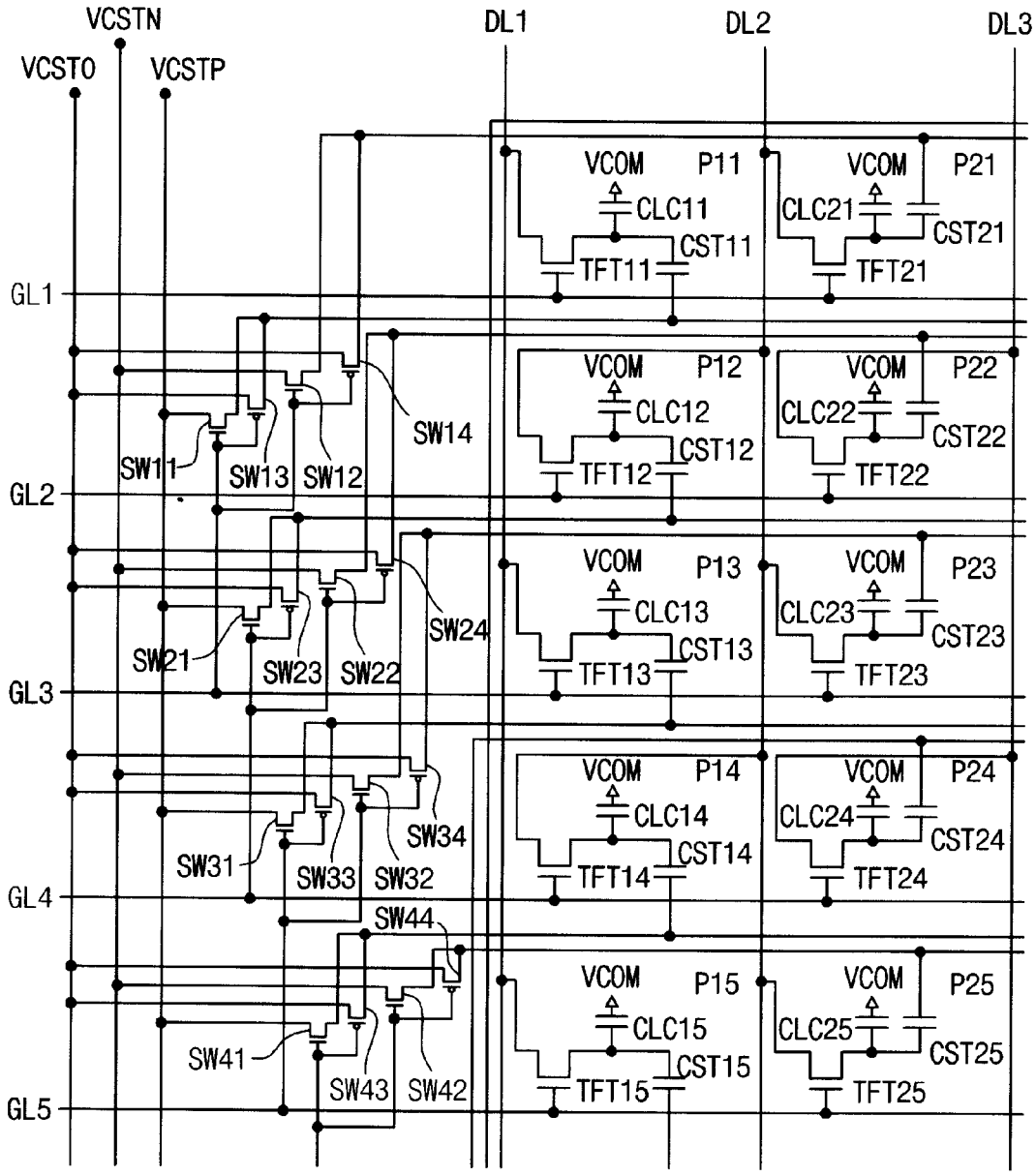
FIG. 5 is a schematic circuit diagram illustrating an alternative exemplary embodiment of a pixel structure of a display panel according to the invention.

FIG. 5 is a schematic circuit diagram illustrating an alternative exemplary embodiment of a pixel structure of a display panel 100 according to the invention.

The circuit diagram in FIG. 5 is substantially the same as the circuit diagram shown in FIG. 2 except that storage switches applying the storage voltage VCST to the pixels connected to the N-th gate line are connected to the (N+2)-th gate line.

An exemplary embodiment of a method of driving the display panel in FIG. 5 is substantially the same as the method of driving the display panel in FIG. 2 except that the gate signals maintain ON state for two horizontal cycles to precharge the pixel for one horizontal cycle 1H. Thus, the same or like elements shown in FIG. 5 have been labeled with the same reference characters as used above to describe the exemplary embodiments of the display panel shown in FIG. 2, and any repetitive detailed description thereof will hereinafter be omitted or simplified.

Referring to the FIGS. 1 and 5, the display panel 100 includes a plurality of pixels, e.g., first to tenth pixels P11, P12, P13, P14, P15, P21, P22, P23, P24 and P25.

The pixels P11 to P25 are disposed in a first pixel column and a second pixel column. The first pixel column includes the first to fifth pixels P11, P12, P13, P14 and P15. The second pixel column includes the sixth to tenth pixels P21, P22, P23, P24 and P25.

Each of the pixels is electrically connected to a corresponding gate line of the gate lines GL and to a corresponding data line of the data lines DL. Each of the data lines DL is alternately connected to the pixels in adjacent pixel columns.

The pixel includes the switching element TFT, the liquid crystal capacitor CLC and the storage capacitor CST.

A plurality of storage switches, e.g., first to sixteenth storage switches SW11, SW12, SW13, SW14, SW21, SW22, SW23, SW24, SW31, SW32, SW33, SW34, SW41, SW42, SW43 and SW44, applies the storage voltage VCST to the display panel 100.

Normal, first and second storage voltages VCST0, VCSTP and VCSTN are applied to the first and sixth pixels P11 and P21, which are connected to a first gate line GL1, through the first to fourth storage switches SW11, SW12, SW13 and SW14, which are connected to a third gate line GL3.

The normal, first and second storage voltages VCST0, VCSTP and VCSTN are applied to the second and seventh pixels P12 and P22, which are connected to a second gate line GL2, through the fifth to eighth storage switches SW21, SW22, SW23 and SW24, which are connected to a fourth gate line GL4.

The normal, first and second storage voltages VCST0, VCSTP and VCSTN are applied to the third and eighth pixels P13 and P23, which are connected to the third gate line GL3, through the ninth to twelfth storage switches SW31 to SW34, which are connected to a fifth gate line GL5.

In such an embodiment, the normal, first and second storage voltages VCST0, VCSTP and VCSTN are applied to the pixels, which are connected to N-th gate line, through the storage switches, which are connected to the (N+2)-th gate line. Here, N is a natural number.

Figure 6:
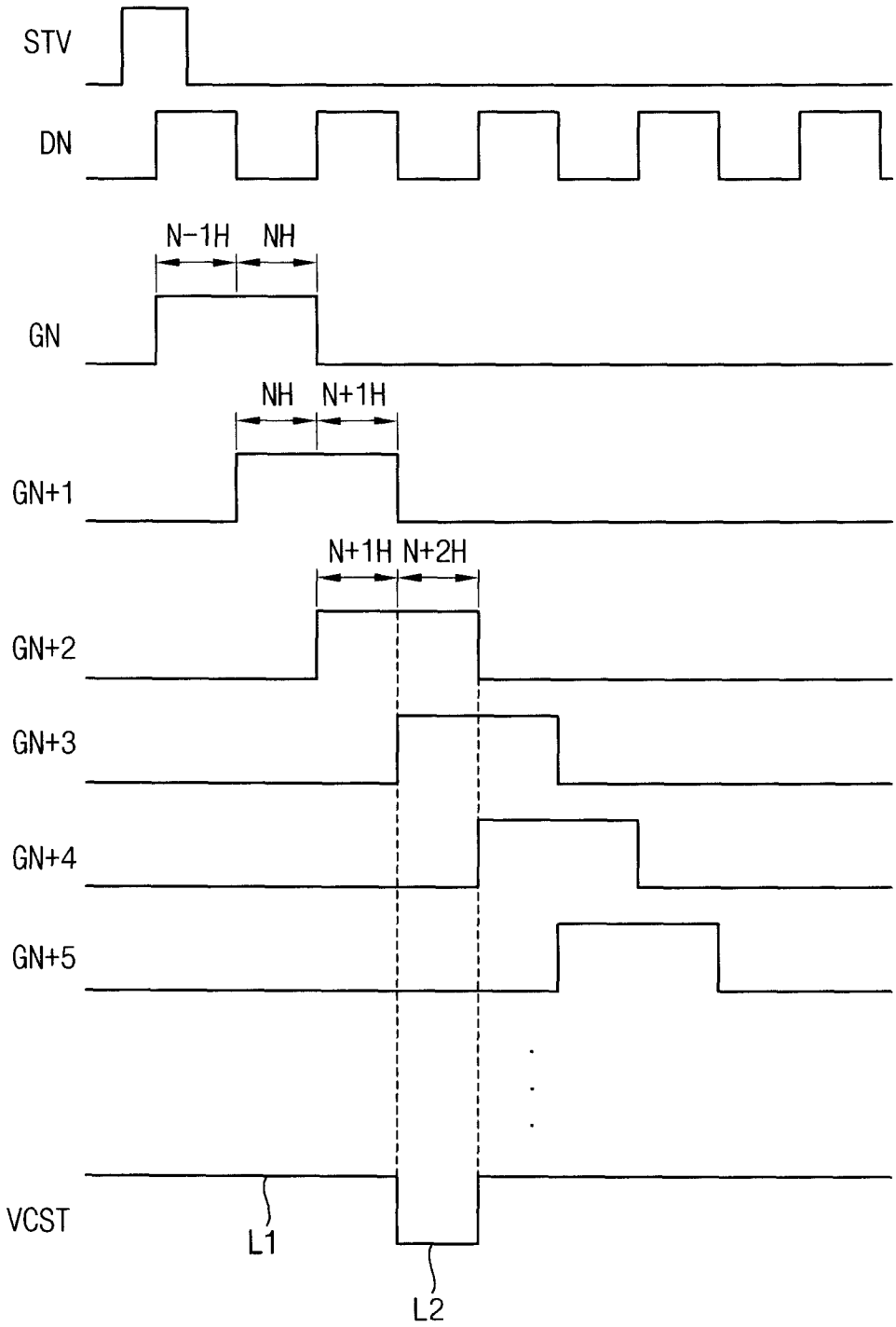
FIG. 6 is a signal timing diagram illustrating driving signals for driving the display panel of FIG. 5.

FIG. 6 is a signal timing diagram illustrating driving signals for driving the display panel 100 of FIG. 5.

Referring to FIGS. 1, 3, 5 and 6, when a vertical start signal STV is in ON state, gate signals are sequentially applied to the gate lines, e.g., a first gate signal is applied to the first gate line GL1 and an N-th gate signal GN is applied to an N-th gate line GLN.

In such an embodiment, the gate signals maintain ON state for two horizontal cycles, such that the grayscale data are precharged to the pixels during a first horizontal cycle, and the grayscale data are charged to the pixels during a second horizontal cycle.

In one exemplary embodiment, for example, the N-th gate signal GN maintains ON state during (N−1)-th and N-th horizontal cycles N−1H and NH. During the (N−1)-th horizontal cycle N−1H, a data voltage DN corresponding to (N−1)-th gate line is precharged to the pixel connected to the N-th gate line. During the N-th horizontal cycle NH, a data voltage DN corresponding to N-th gate line is charged to the pixel connected to the N-th gate line.

In one exemplary embodiment, for example, the (N+1)-th gate signal GN+1 maintains ON state during N-th and (N+1)-th horizontal cycles NH and N+1H. During the N-th horizontal cycle NH, a data voltage DN corresponding to N-th gate line is precharged to the pixel connected to the N-th gate line. During the (N+1)-th horizontal cycle N+1H, a data voltage DN corresponding to (N+1)-th gate line is charged to the pixel connected to the (N+1)-th gate line.

When the data voltage DN applied during the (N−1)-th horizontal cycle N−1H corresponds to a relatively high grayscale, and the data voltage DN applied to the N-th horizontal cycle NH corresponds to a relatively low grayscale, the display error may be occurred at the pixel connected to the N-th gate line.

When the display error occurs at the pixel connected to the N-th gate line, the grayscale data compensating part 220 increases input grayscale data DATA of the data lines, except for the data line at which the display error occurs, to generate compensated grayscale data CDATA.

Accordingly, the data driver 500 outputs a data voltage corresponding to a grayscale higher than a grayscale of the input grayscale data DATA to the pixels connected to the N-th gate line based on the compensated grayscale data CDATA.

The storage voltage VCST has the first level L1 during (N−1)-th to (N+1)-th horizontal cycles N−1H to N+1H. The storage voltage VCST has the second level L2 lower than the first level L1 during (N+2)-th horizontal cycle N+2H.

Referring again to FIG. 5, the (N+2)-th gate line is connected to the storage switches that apply the storage voltage VCST to the pixels connected to the N-th gate line.

During the (N+2)-th horizontal cycle N+2H, the storage voltage having the second level L2 lower than the first level L1 decreases the data voltage charged to the pixels connected to the N-th gate line.

Accordingly, the pixels connected to the N-th gate line, which are compensated to display a grayscale higher than a desired grayscale by the grayscale data compensating part 220, may display the desired grayscale. Thus, the display error on the display panel 100 is effectively prevented.

The time period during which the storage voltage VCST has the second level L2 is not limited to the (N+2)-th horizontal cycle N+2H. In an exemplary embodiment, the storage voltage VCST may have the second level L2 during an (N+K)-th horizontal cycle. Here, K is a natural number. When the time point when the storage voltage VCST has the second level L2 is changed, the gate line connected to the control electrodes of the storage switches may be also changed.

In an exemplary embodiment, K may be greater than or equal to 2. When the storage voltage VCST has the second level L2 after (N+2)-th horizontal cycle, in which the N-th gate signal applied to the N-th gate line maintains OFF state, the display panel 100 may be driven more stably.

According to the exemplary embodiment shown in FIGS. 1, 2, 5 and 6, the error detecting part 210 detects the display error. The grayscale data compensating part 220 compensates the input grayscale data DATA. The storage voltage generator 300 adjusts a level of the storage voltage VCST. Thus, the display error on the display panel 100 is effectively prevented.

According to the exemplary embodiments as described herein, the grayscale data are compensated, the storage voltage is adjusted such that the display error is effectively prevented. Thus, display quality of the display panel is substantially improved.

The foregoing is illustrative of the invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of driving a display panel, the method comprising:

generating compensated grayscale data by increasing grayscale data corresponding to an N-th gate line of a plurality of gate lines of the display panel, wherein N is a natural number;

generating, by a data driver, a data voltage based on the compensated grayscale data, and outputting the data voltage to the display panel including a plurality of pixel electrodes and a plurality of data lines, wherein each of the plurality of data lines is alternately connected to the plurality of pixel electrodes in a first pixel column and the plurality of pixel electrodes in a second pixel column;

generating, by a storage voltage generator, a storage voltage having a first level and a second level, wherein the second level is lower than the first level; and applying, by the storage voltage generator, the storage voltage to a storage electrode of the display panel, wherein the storage voltage is applied to the display panel based on a gate signal from a gate line of the plurality of gate lines, and wherein the grayscale data corresponding to the plurality of data lines except for the grayscale data corresponding to an M-th data line of the plurality of data lines are increased when a display error is detected at the grayscale data corresponding to the M-th data line, wherein M is a natural number.

2. The method of claim 1, further comprising detecting the display error based on the grayscale data, wherein the grayscale data is increased when the display error is detected.

3. The method of claim 2, wherein the detecting the display error includes comparing previous grayscale data corresponding to an (N−1)-th gate line with present grayscale data corresponding to the N-th gate line.

4. The method of claim 3, wherein the display error is detected when the previous grayscale data is greater than the present grayscale data.

5. A method of driving a display panel, the method comprising:

generating compensated grayscale data by increasing grayscale data corresponding to an N-th gate line of a plurality of gate lines of the display panel, wherein N is a natural number;

generating a data voltage based on the compensated grayscale data, and outputting the data voltage to the display panel including a plurality of pixel electrodes and a plurality of data lines, wherein each of the plurality of data lines is alternately connected to the plurality of pixel electrodes in a first pixel column and the plurality of pixel electrodes in a second pixel column;

generating a storage voltage having a first level and a second level, wherein the second level is lower than the first level; and applying the storage voltage to the display panel, wherein the storage voltage is applied to the display panel based on an (N+K)-th gate signal, wherein K is a natural number.

6. The method of claim 5, wherein the storage voltage has the second level during an (N+K)-th horizontal cycle.

7. The method of claim 6, wherein a gate signal applied to the N-th gate line maintains a turned-on state during an (N−2)-th horizontal cycle, an (N−1)-th horizontal cycle and an N-th horizontal cycle, the pixel electrode connected to the N-th gate line is precharged during the (N−2)-th horizontal cycle and the (N−1)-th horizontal cycle, and K is greater than or equal to 3.

8. The method of claim 6, wherein a gate signal applied to the N-th gate line maintains a turned-on state during an (N−1)-th horizontal cycle and an N-th horizontal cycle, the pixel electrode connected to the N-th gate line is precharged during the (N−1)-th horizontal cycle, and K is greater than or equal to 2.

9. The method of claim 1, wherein a pixel of the display panel has a rectangular shape, and a longitudinal side of the pixel is substantially parallel to the plurality of gate lines.

10. A display apparatus comprising:

a display panel comprising a plurality of pixel electrodes, a plurality of gate lines and a plurality of data lines, wherein each of the plurality of data lines is alternately connected to the plurality of pixel electrodes in a first pixel column and the plurality of pixel electrodes in a second pixel column;

a grayscale data compensating part which generates compensated grayscale data by increasing grayscale data corresponding to an N-th gate line, wherein N is a natural number;

a data driver which generates a data voltage based on the compensated grayscale data and outputs the data voltage to the display panel; and a storage voltage generator which generates a storage voltage having a first level and a second level and applies the storage voltage to a storage electrode of the display panel, wherein the second level is lower than the first level, wherein the storage voltage generator is different from the data driver, wherein the storage voltage is applied to the display panel based on a gate signal from a gate line of the plurality of gate lines, and wherein the grayscale compensating part increases the grayscale data corresponding to the plurality of data lines except for the grayscale data corresponding to an M-th data line of the plurality of data lines when a display error is detected at the grayscale data corresponding to the M-th data line, wherein M is a natural number.

11. The display apparatus of claim 10, further comprising an error detecting part which detects the display error based on the grayscale data, wherein the grayscale data compensating part increases the grayscale data when the display error is detected.

12. The display apparatus of claim 11, wherein the error detecting part compares previous grayscale data corresponding to an (N−1)-th gate line with present grayscale data corresponding to the N-th gate line to detect the display error.

13. The display apparatus of claim 12, wherein the error detecting part detects the display error when the previous grayscale data is greater than the present grayscale data.

14. The display apparatus of claim 10, further comprising a storage switch which applies the storage voltage to the storage electrode of the display panel, and wherein the storage voltage is applied to the display panel based on an (N+K)-th gate signal, and K is a natural number.

15. The display apparatus of claim 14, wherein the storage voltage has the second level during an (N+K)-th horizontal cycle.

16. The display apparatus of claim 15, wherein a gate signal applied to the N-th gate line maintains a turned-on state during an (N−2)-th horizontal cycle, an (N−1)-th horizontal cycle and an N-th horizontal cycle, the pixel electrode connected to the N-th gate line is precharged during the (N−2)-th horizontal cycle and the (N−1)-th horizontal cycle, and K is greater than or equal to 3.

17. The display apparatus of claim 15, wherein a gate signal applied to the N-th gate line maintains a turned-on state during an (N−1)-th horizontal cycle and an N-th horizontal cycle, the pixel electrode connected to the N-th gate line is precharged during the (N−1)-th horizontal cycle, and K is greater than or equal to 2.

18. The display apparatus of claim 10, wherein a pixel of the display panel has a rectangular shape, and a longitudinal side of the pixel is substantially parallel to the plurality of gate lines.

* * * * *